US005924172A

United States Patent [19]

Klein

[11] Patent Number: 5,924,172

[45] Date of Patent: Jul. 20, 1999

[54] WEATHER RESISTANT STRUCTURES FOR CONVENTIONAL SLIDE FASTENERS AND METHODS FOR MAKING THE SAME

[75] Inventor: Sheila M. Klein, Seattle, Wash.

[73] Assignee: Cascade Designs, Inc., Seattle, Wash.

[21] Appl. No.: 08/867,470

[22] Filed: Jun. 2, 1997

Related U.S. Application Data

[60] Provisional application No. 60/019,432, Jun. 3, 1996.

[51] Int. Cl.[6] ..... A44B 19/32

[52] U.S. Cl. ..... 24/389; 24/432; 24/384; 2/96

[58] Field of Search ..... 24/389, 397, 398, 24/394, 432, 384; 2/234, 96, 217

[56] References Cited

U.S. PATENT DOCUMENTS

| | | | |
|---|---|---|---|
| 2,097,099 | 10/1937 | Legat | 24/205 |
| 2,311,556 | 2/1943 | Marinsky | 139/283 |
| 2,371,776 | 3/1945 | Orman | 24/389 |
| 2,385,816 | 10/1945 | Krupp | 2/96 |
| 2,422,249 | 6/1947 | Malluk | 36/50 |
| 2,615,224 | 10/1952 | Shur | 24/384 |
| 2,641,037 | 6/1953 | Gossner | 24/201.1 |
| 3,102,570 | 9/1963 | Fairchilds | 150/3 |
| 3,335,425 | 8/1967 | Senser | 2/96 X |
| 3,409,953 | 11/1968 | Briscoe | 24/205.1 |
| 3,417,406 | 12/1968 | Rosenbaum | 2/2.17 |
| 3,490,109 | 1/1970 | Heimberger | 24/205.1 |
| 3,501,816 | 3/1970 | Heimberger | 24/205.1 |
| 3,516,409 | 6/1970 | Howell | 128/335 |
| 3,624,871 | 12/1971 | Osterkorn | 24/389 |
| 3,827,085 | 8/1974 | Ackermann | 2/234 |
| 3,962,729 | 6/1976 | Cook | 24/432 X |
| 4,130,917 | 12/1978 | Shopalovich | 24/205 |
| 4,606,079 | 8/1986 | DeWoskin | 24/432 X |
| 4,628,545 | 12/1986 | Metzler | 24/432 X |
| 4,875,258 | 10/1989 | Goedecke | 24/389 |
| 4,922,586 | 5/1990 | Robson | 24/399 |
| 4,977,622 | 12/1990 | Moreland | 24/389 |
| 5,127,106 | 7/1992 | Aldridge | 2/96 X |
| 5,159,719 | 11/1992 | Aumann | 2/96 X |
| 5,199,530 | 4/1993 | Murabayashi et al. | 24/403 |
| 5,444,898 | 8/1995 | Norvell | 24/389 |

*Primary Examiner*—James R. Brittain
*Assistant Examiner*—Robert J. Sandy
*Attorney, Agent, or Firm*—Graybeal Jackson Haley LLP

[57] ABSTRACT

The present invention is directed to a fluid resistant structure to be incorporated with conventional fastening systems such as slide fasteners. Two sheaths are attached or incorporated into a closable structure, in overlapping fashion, at or near the opening of the structure. Each sheath has associated therewith a semi-rigid bead portion at its mesial portion. The length of the bead portions is generally longer than the chord length of the opening so that a slight, to pronounced, arch or bow of the beads is formed. When the structure is closed, one bead is manipulated over and laterally adjacent to the other bead, thereby forming a lateral compression abutment between the two beads. The lateral abutment is maintained due in part to the arch or bow formed by the difference between the bead length versus the chord length. Variations of the invention include having the upper sheath extend over the fastening elements, having the lower sheath extend over the fastening elements, and having both sheaths extend over the fastening elements. In addition, various geometries of beads can be used and include beads having cylindrical, triangular, and square cross-sections.

22 Claims, 2 Drawing Sheets

FIG. 1
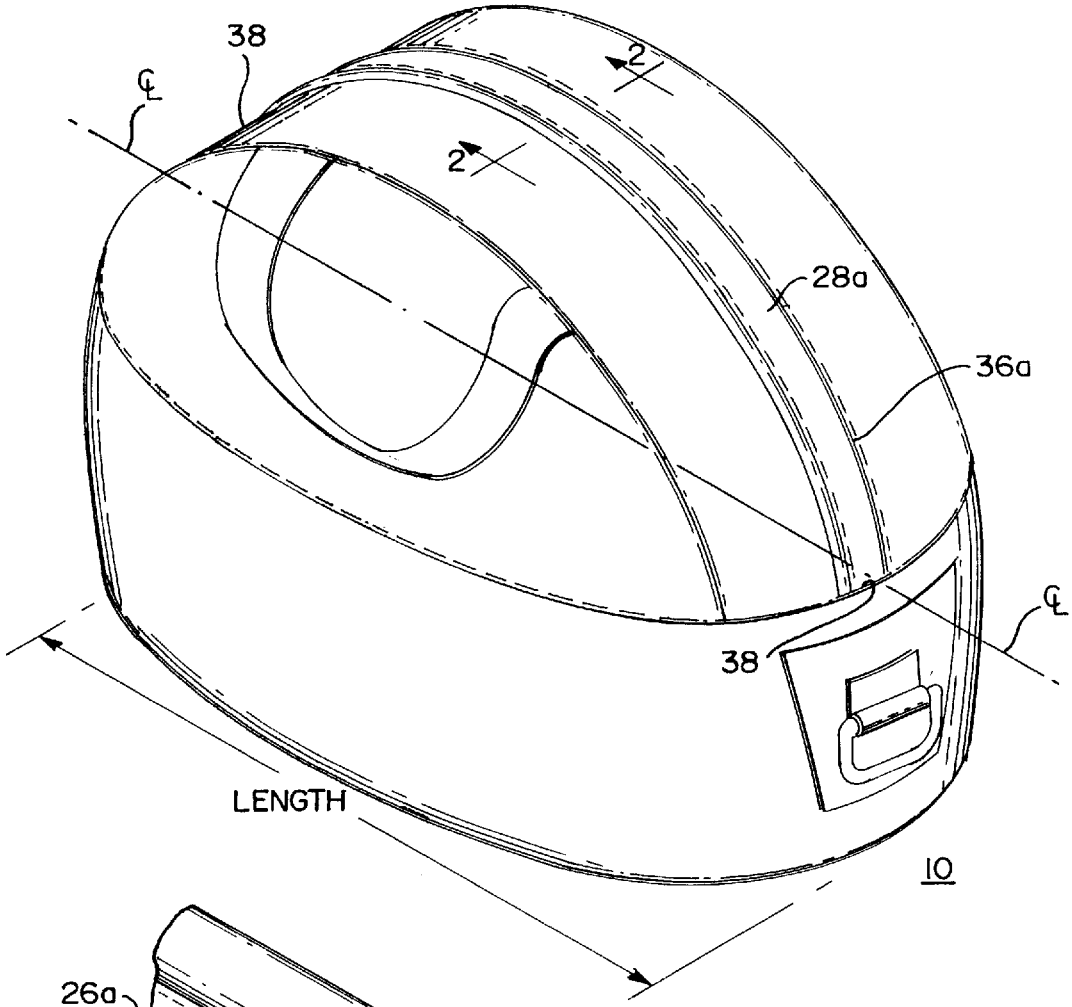
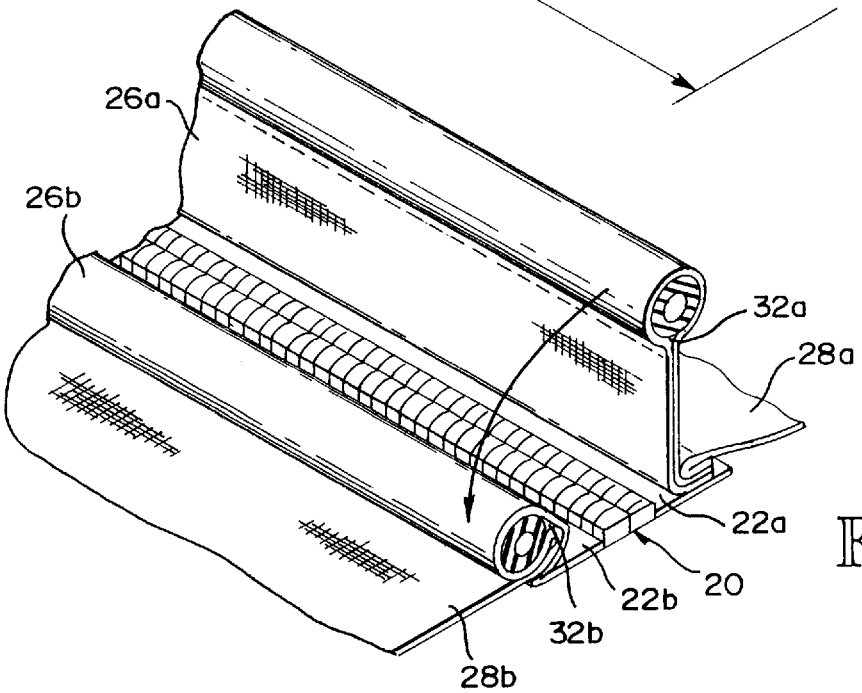
FIG. 2

FIG. 3
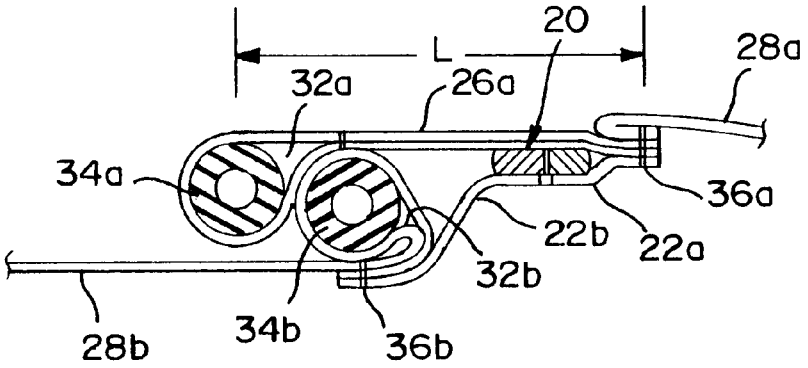
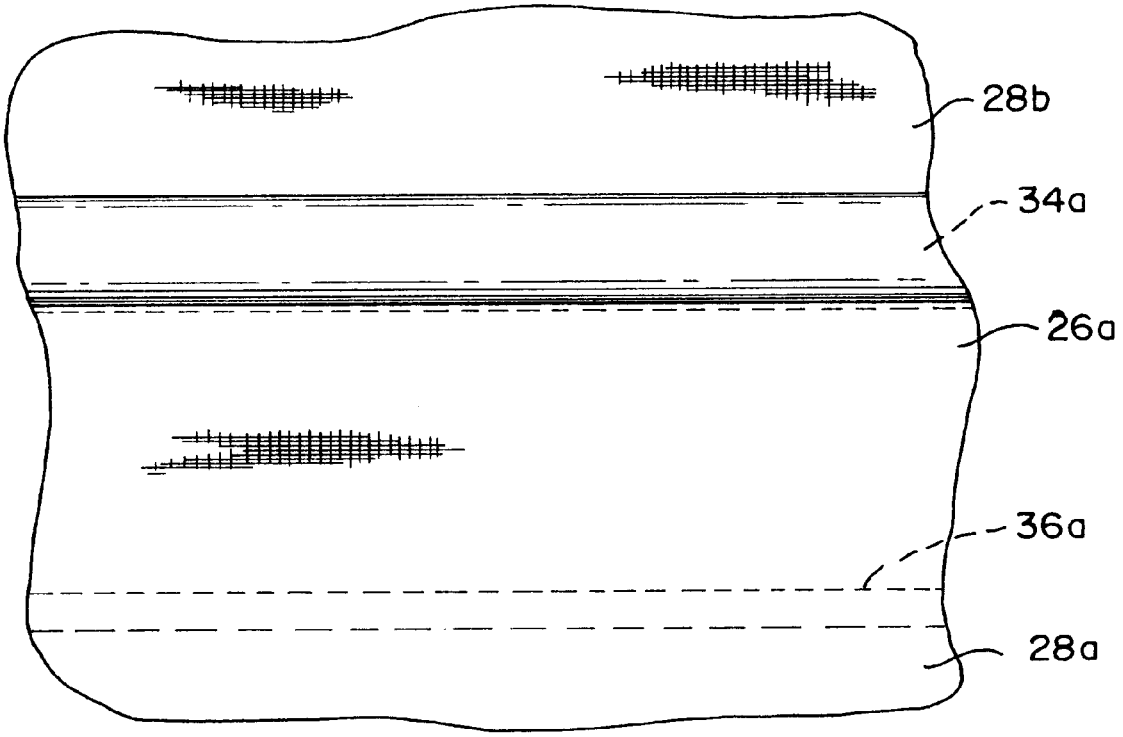
FIG. 4

WEATHER RESISTANT STRUCTURES FOR CONVENTIONAL SLIDE FASTENERS AND METHODS FOR MAKING THE SAME

The application claims benefit of Provisional Appl. No. 60/019,432, filed Jun. 3, 1996.

FIELD OF THE INVENTION

The present invention is directed to the field of slide fasteners and more particularly to a structure for providing a generally sealable outer interlock to shield a slide fastener from fluids such as air, rain, snow, splash, or the like.

BACKGROUND OF THE INVENTION

In the art of slide fasteners or zippers, it has long been desirable to make the slide fastener water proof or water resistant. Some solutions were directed to making the zipper structure itself water impervious. Other solutions relied on forming an interlocking fit with ancillary material directly adjacent the zipper so that the ancillary material would form a barrier between the environment and the zipper. An example of the later can be found in U.S. Pat. No. 3,490,109 (the '109 patent).

In the '109 patent, the means for providing a sealing closure was effectuated by integrating coupling members or zipper teeth in an elastic sealing strip located above the outer portion of the teeth so that when the teeth were meshed during closure, the sealing strip would likewise form an interlock in a tongue and groove manner. This solution, however, required the custom manufacture of specialty zippers since the teeth were integral with the sealing strip. Consequently, while providing a seal, the costs of manufacture were comparatively high to those of conventional zippers.

Another solution proposed by the prior art and exemplified in U.S. Pat. No. 3,624,871 (the '871 patent) provided for highly overlapped zipper flaps that extended over the outer zipper structure. While this structure provided a low cost solution to the challenge, the deficiency of this design, however, was the structure's failure to provide some positive means for maintaining the overlap.

In view of the foregoing, it is apparent that a need exists for a simple and low cost means for providing a water resistant slide fastener, or an outer closure structure for use with conventional slide fasteners. The present invention is intended to meet these needs and is directed to the later.

SUMMARY OF THE INVENTION

The present invention is directed to providing a generally self-sustaining, sealing shield using two outer sheaths in conjunction with a two-part fastening system associated with a closable opening. The shield structure can be used in combination with most any type of fastening system, including low cost tooth or coil-type slide fasteners or hook and loop fasteners, since its operation is independent of the type of fastening system used. Additionally, it can be incorporated as part of the article or separately manufactured and integrated into the end product.

Using a conventional slide fastener having two stringer tapes, for example, a first sheath portion and a second sheath portion are attached to a first and a second stringer tape, respectively. Each sheath portion has a distal and mesial portion with the mesial portions being located generally proximate to the slide fastener coupling elements. The mesial portion of the first sheath portion extends over the coupling elements while the mesial portion of the second sheath portion is positioned adjacent to the coupling element so that when the coupling elements are engaged and the sheaths portions appropriately manipulated, the first sheath portion's mesial portion lies over and above the second sheath portion's mesial portion. To retain the desired self-sustaining closure, associated with each mesial portion is a longitudinal bead extending substantially the length of each stringer tape. Each bead is positioned relative to each mesial portion so that when manipulated into the overlapped position, one bead will be in a slight lateral compressive contact with the other bead. Thus, the degree of bead overlap is sufficient so that the upper bead is laterally displaced from the lower bead, but is not so far displaced so as to be spaced adjacently therefrom since in order to effectuate a preferred seal, the two beads should be in compressive contact with one another.

In preferred form, each bead comprises a closed hem formed in the mesial portion of a sheath in which is situated a semi-rigid, tubular material such as Norprene™ (Ryan Herco, formulation A60G/A60F). The length of the semi-rigid, tubular material is preferably equal to or greater than the length of the hem, thereby restricting axial movement of the tubular material in the hem. To create a self-sustaining seal, it is desirable to cause the tubular member to form an arch. The arch formation is preferably carried out by making the hem length greater than the chord length of the structure as measured between the end points of the hem. When both beads are created in this fashion and the beads placed in the described overlapping configuration, the resulting structure forms a bowed comma-type seal that advantageously prevents depressions from forming at or adjacent the fastener when placed in the horizontal position, and creates a compression seal. When such a structure is used in combination with a bag, for example, the likelihood of water penetrating the overlap and entering the bag through the putatively porous fastener is nearly eliminated.

A principal advantage of the invention is that a water resistant structure can be formed even when using conventional coil-type slide fasteners, which are notoriously water permeable but extremely inexpensive to manufacture. Moreover, the disclosed invention can be used with nearly any type of fastening system used to join two panel-type members. Examples of such fastening systems include lacing systems, hook and loop systems, and snap systems.

It is to be understood that the described overlap can be effectuated at the opening, or to either side of the opening to be sealed. Moreover, since the transverse or lateral distance of one sheath portion (as measured from the distal attachment point to the mesially located bead) is usually longer than the other sheath portion, either sheath may assume the superior position, i.e., the upper position. However, the preferred embodiment described in detail below uses the longer of the two sheaths as the superior sheath.

BRIEF DESCRIPTION OF THE DRAWINGS

FIG. 1 is a perspective view of a duffel-type bag incorporating the invention;

FIG. 2 is a partial perspective view, taken substantially along the line 2—2 in FIG. 1, wherein the invention is shown in an open state;

FIG. 3 is an end view of the cross section of FIG. 2 wherein the invention is shown in a closed state; and FIG. 4 is a plan view of the invention as shown in FIG. 3.

DETAILED DESCRIPTION OF THE INVENTION

Turning then to the several figures wherein like numerals indicate like parts, and more particularly to FIG. 1, a duffel-type bag 10 is shown incorporating the invention. As can be seen from inspection thereof, no portion of zipper 20 is exposed—only panel 28*a* is exposed to the environment.

Construction: A detailed view of the invention is shown best in FIGS. 2 and 3. Zipper 20 consists of stringer tapes 22*a* and 22*b* which hold coupling elements 24*a* and 24*b* properly aligned as is well known in the art. Attached to the distal portions of stringer tapes 22*a* and 22*b* are panels 28*a* and 28*b* respectively. Panel 28*b* also forms sheath portion 26*b* while a separate sheath portion 26*a* is attached to the distal portion of stringer tape 22*a*. Whether a separate sheath is to be used, or not is a design consideration.

Sheath portions 26*a* and 26*b* are attached to stringer tapes 22*a* and 22*b* respectively by way of stitching 36*a* and 36*b*. When carrying out the attachment, hems 32*a* and 32*b* are formed so as to permit residence of semi-rigid members 34*a* and 34*b* therein. Semi-rigid members or tubes 34*a* and 34*b* are preferably constructed from Norprene$^{tm}$ tubing and have an outer diameter appropriate for the opening size, and visually between approximately 0.25" and 0.75" OD. Each tube has a length at least as long as the longitudinal length of each corresponding hem. Bowing such as shown in FIG. 1 can be accomplished by, for example, decreasing the chord length between hem ends 38 (indicated as dashed line "cl"). The greater the decrease in chord length cl relative to the hem length, the greater the arch or bow, and therefore, the greater resistance to compressional deflection.

As best shown in FIG. 3, the maximum length "L" from tube 34*a* to stringer tape 22*a* is critical to the operation and effectiveness of the invention. Tube 34*a* must be able to laterally extend beyond tube 34*b*, but not so far so as to loose compressional contact therewith when panels 28*a* and 28*b* are brought into tension. Conversely, too little length "L" will causes tube 34*a* to ride on tube 34*b*, thus decreasing the effectiveness of the physical seal between tubes 34*a* and 34*b*.

The previously described bowing effect of the tubes advantageously causes both tubes to achieve a similar radius, thus reducing the potential of tube 34*a* to ride on tube 34*b* and maintain appropriate lateral compression against one another. In other words, tube 34*b* is urged against sheath portion 26*a* while sheath portion 26*a* resists such a moment because both tubes 34*a* and 34*b* conform to a similar radius. Since tube diameters and bowing configurations vary from application to application, no one length "L" is proper. It is only required that the length of each tube, and impliedly each hem, is generally the same so as to achieve a similar bow geometry. If one tube is to have a lesser radius than the other, then the lesser radius tube should be the exposed tube, or in the figures, tube 34*a*.

Effectiveness: To determine the effectiveness of the present invention, an initial comparison was made between two duffel bags: 1700 in$^3$ bags having top fabrics of 500# denier Cordura with a ¾ ounce IDWR urethane coating, 20 ounce vinyl sides, and 34 ounce vinyl bottoms. Bag "A" incorporated the invention while bag "B" had standard zipper flaps.

Each bag was either filled to capacity or half capacity with packing balls, securely zipped to the closed position, and subjected to simulated rain and splash by emptying one gallon of water from a garden watering bucket over the top portion of the bag as rapidly as possible without spilling water from the top of the bucket. The spray nozzle of the bucket was placed 12 inches from the top of the bag.

After subjecting each bag to the test conditions, both at half and full capacity, bag "A", utilizing the invention, showed no leakage whatsoever. By contrast, bag "B" had an average leakage of 77 ml at full capacity and 186 ml at half capacity with the zippers to one side, and 209 ml and 718 ml respectively when the zippers were centered. In most experiments, bag "B" collapsed under the weight of the applied water, causing puddling on the bag's upper section near the zipper, thereby exacerbating the entry of water into the bag.

A second series of tests were later carried out using bags of the same construction as was used in the initial comparison, but with volumes of 30 liters and 150 liters. Bag "A" was a control 30 liter duffle-type bag; bag "B" was a 30 liter duffle-type bag incorporating the invention and using ¼ inch OD tubing; bag "C" was a 150 liter bag incorporating the invention and using ¼ inch CD tubing; bag "D" was the same as bag "C" except that ⅜ inch tubing was used.

Each bag was then subjected to a water intrusion spray test procedure. The procedure involved filling a bag with packing balls, closing the bag, and exposing the bag to a continuous water spray emanating from three 2 gpm nozzles (0°, 45°, and 90° from horizontal) for 8 minutes wherein the bag was rotated horizontally 45° every minute. After exposure, the packing balls were removed and the volume of water in the bag was measured. The results of the second series of tests confirmed the earlier test results.

In addition to the foregoing, various types and diameters of beads can be used. While tubular materials having outside diameters of between 0.25 and 0.75 are preferred, other shapes are contemplated such as beads having square or triangular cross sections. Moreover, materials other than Norprene$^{tm}$ can be used, e.g., silicone or high density polyethylene.

What is claimed:

1. An auxiliary, self-sustaining shield for use with a closable, longitudinally oriented opening defined by an edge portion of a first panel of flexible material having an outer and an inner surface, and an edge portion of a second opposing panel of flexible material having an outer and inner surface, the shield comprising:

a first sheath having a distal edge portion and a mesial edge portion, and having a length substantially equal to the length of the closable opening wherein the distal edge portion of the first sheath is securable to an outer portion of the first panel, and wherein a longitudinal bead is associated with the mesial edge portion of the first sheath; and a second sheath having a distal edge portion and a mesial edge portion, and having a length substantially equal to the length of the closable opening wherein the distal edge portion of second sheath is securable to an outer portion of the second panel, and wherein a longitudinal bead having a substantially circular, triangular, or square shaped cross section is associated with the mesial edge portion of the second sheath.

2. The shield of claim 1 wherein the transverse distance of the first sheath is greater than the transverse distance of the second sheath and whereby when the first panel edge portion and the second panel edge portion are brought into close proximity, the mesial edge portion of the first sheath can be brought above and beyond the mesial edge portion of the second sheath and urged downwardly whereafter frictional contact between the longitudinal bead of the first sheath and the longitudinal bead of the second sheath maintains the contacting relationship between the two beads.

3. The shield of claim 1 wherein the transverse distance of the second sheath is greater than the transverse distance of the first sheath and whereby when the first panel edge portion and the second panel edge portion are brought into close proximity, the mesial edge portion of the second sheath can be brought above and beyond the mesial edge portion of the first sheath and urged downwardly where after frictional contact between the longitudinal bead of the first sheath and the longitudinal bead of the second sheath maintains the contacting relationship between the two beads.

4. The shield of claim 1 wherein the bead of the first sheath and the bead of the second sheath are semi-rigid cylinders.

5. The shield of claim 4 wherein the semi-rigid cylinders have an annular cross-section.

6. The shield of claim 1 wherein the bead of the first sheath and the bead of the second sheath are semi-rigid members of non-circular cross-section.

7. The shield of claim 4 wherein the semi-rigid cylinders are formed from a foamed polymeric material.

8. The shield of claim 1 wherein the beads of the first sheath and of the second sheath comprise a hem formed from the first sheath and the second sheath respectively and a section of semi-rigid material disposed in each resulting hem.

9. The shield of claim 1 wherein the beads of the first sheath and of the second sheath comprise a section of semi-rigid material attached to a mesial portion of the first sheath and a section of semi-rigid material attached to a mesial portion of the second sheath.

10. The shield of claim 1 wherein the bead of the first panel and the bead of the second panel have outside diameters of substantially between 0.25 and 0.75 inches.

11. The shield of claim 1 wherein the first and second panels are constructed from a fluid impervious material.

12. The shield of claim 1 further comprising a two part closure system wherein a first part of the two part closure system is affixable to the edge portion of the first panel, and a second part of the two part closure system is affixable to the edge portion of the second panel.

13. The shield of claim 12 wherein the two part closure system is selected from the group consisting of a coil slide fastener, a tooth type slide fastener, a longitudinal continuous seal slide fastener, a hook and loop fastener, a snap fastener, and a lace and eyes fastener.

14. An auxiliary, self-sustaining shield for use with a closable, longitudinally oriented opening defined by an edge portion of a first panel of flexible material having an outer and an inner surface and an edge portion of a second opposing panel of flexible material having an outer and an inner surface wherein a first stringer tape of a coil slide fastener is attached to the first panel edge portion and a second stringer tape of a coil slide fastener is attached to the second panel edge portion, the shield comprising:

a first sheath having a distal portion and a mesial portion, and having a length substantially equal to the length of the closable opening wherein the distal portion of the first sheath is securable to a portion of the first stringer and the mesial portion of the first sheath extends over the edge portion of the second panel when the edge portions of the first panel and the second panel are in close proximity to one another, and wherein a longitudinal bead having a substantially circular, triangular, or square shaped cross section is formed in the mesial portion of the first sheath; and a second sheath having a distal portion and a mesial portion, and having a length substantially equal to the length of the closable opening wherein the distal portion of second sheath is securable to a portion of the second stringer and the mesial portion of the second sheath is adjacent to the second stringer, and wherein a longitudinal bead is formed in the mesial portion of the second sheath, whereby when the first panel edge portion and the second panel edge portion are brought into close proximity, the mesial portion of the first sheath can be brought above and beyond the mesial portion of the second sheath and urged downwardly whereafter frictional contact between the longitudinal bead of the first sheath and the longitudinal bead of the second sheath maintains the contacting relationship between the two beads.

15. A sealing arrangement for a closable, longitudinally oriented opening defined by a first panel of flexible material having an edge portion, an outer surface, an inner surface and a first part of a two part closure, and a second opposing panel of flexible material having an edge portion, an outer surface, inner surface and a second part of a two part closure, the arrangement comprising:

a first longitudinal bead adapted to be located at the outer surface of the first panel edge portion, the first bead having a substantially circular, triangular or square shaped cross section and a length substantially equal to the length of the closable opening; and a second longitudinal bead adapted to be located at the outer side of the second panel edge portion, the second bead having a length substantially equal to the length of the closable opening wherein the first bead is extendable over and above the two part closure when the first part of the two part closure is engaged with the second part thereof so that the first bead is laterally proximate to the second bead and a portion of the first panel is adapted to lay over the two part closure.

16. The arrangement of claim 15 wherein the first bead and the second bead are semi-rigid cylinders.

17. The arrangement of claim 16 wherein the semi-rigid cylinders have an annular cross-section.

18. The arrangement of claim 15 wherein the first bead and the second bead are semi-rigid members of non-circular cross-section.

19. The arrangement of claim 15 wherein the first and second beads each comprise a section of semi-rigid material, each adapted to be disposed in a hem formed in the edge portions of the first and second panels.

20. The arrangement of claim 15 wherein the first and second beads comprise a section of semi-rigid material attachable to the edge portion of the first panel and a section of semi-rigid material attachable to the edge portion of the second panel, respectively.

21. The arrangement of claim 15 wherein the first and second beads have outside diameters of substantially between 0.25 and 0.75 inches.

22. The arrangement of claim 15 wherein the first and second panels are constructed from a fluid impervious material.

* * * * *